US005143397A

United States Patent [19]

Stepanek et al.

[11] Patent Number: 5,143,397

[45] Date of Patent: Sep. 1, 1992

[54] SKI BINDING

[75] Inventors: Premek Stepanek, Garmisch-Partenkirchen; Ludwig Wagner, Farchant, both of Fed. Rep. of Germany

[73] Assignee: Marker International, Salt Lake City, Utah

[21] Appl. No.: 389,318

[22] Filed: Aug. 3, 1990

[30] Foreign Application Priority Data

Aug. 3, 1988 [DE] Fed. Rep. of Germany ..... 3826424

[51] Int. Cl.[5] ..... A63C 9/00

[52] U.S. Cl. ..... 280/633

[58] Field of Search ..... 280/607, 617, 618, 633, 280/634, 636, 623

[56] References Cited

U.S. PATENT DOCUMENTS 3,614,117 10/1971 Iizuka ..... 280/633
3,807,748 4/1974 Ramillon ..... 280/633
4,147,378 4/1979 Reich ..... 280/633

FOREIGN PATENT DOCUMENTS 2306852 8/1974 Fed. Rep. of Germany ..... 280/633
2521746 11/1976 Fed. Rep. of Germany ..... 280/633
1464104 11/1966 France ..... 280/633

*Primary Examiner*—Andres Kashnikow
*Assistant Examiner*—Michael Mar
*Attorney, Agent, or Firm*—D. Peter Hochberg; Mark Kusner; Louis J. Weisz

[57] ABSTRACT

A part for a ski binding comprising a carriage slidably attached to a base plate. One end of the base plate is fastened to the ski with fasteners, while its other end rests freely on the bottom of a U-shaped clamp, also fastened to the ski with fasteners. Attachment of the carriage to the base plate is accomplished by carriage structural features that retain the carriage in the clamp, and further carriage structural features that prevent the carriage from being vertically disengaged from the part of the base plate adjacent to the base plate's fastened end. However, such features allow the carriage to be moved horizontally back and forth relative to the base plate along the longitudinal axis of the ski. The ski binding part disclosed prevents a substantial amount of the vertical forces ordinarily experienced during skiing from being transmitted to the ski through the base plate, allowing the base plate to be made of lightweight construction.

16 Claims, 5 Drawing Sheets

FIG. 3
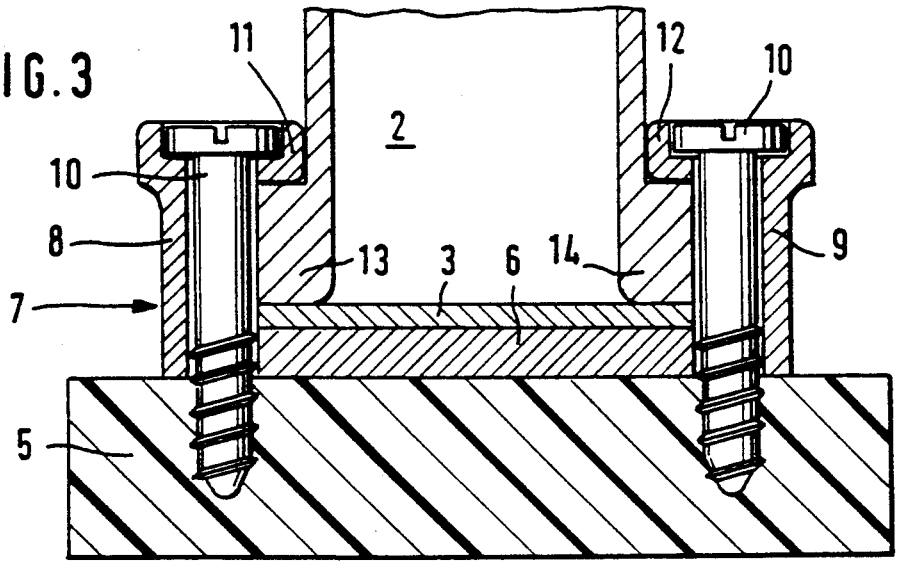
FIG. 4
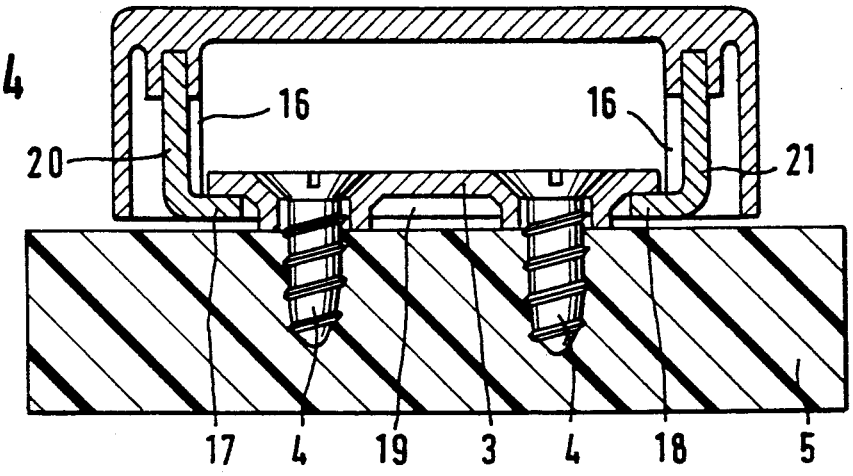
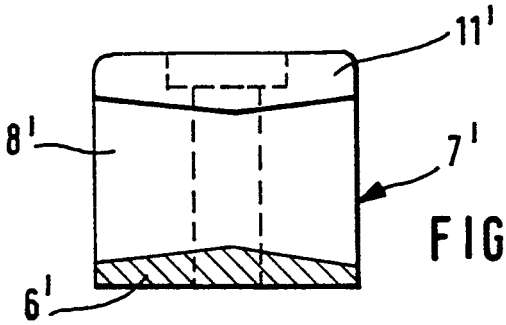
FIG. 5

SKI BINDING

TECHNICAL FIELD

This invention relates to ski bindings. More particularly, this invention relates to ski bindings employing lightweight base plates. Specifically, this invention relates to ski binding in which the carriage of the ski binding is attached to the ski's base plate in a manner that allows tensile forces on the bindings encountered during skiing to be transferred from the carriage directly to the ski, rather than from the carriage to the ski through the base plate, in order to achieve an effective but lightweight ski binding.

BACKGROUND OF THE INVENTION

In the past, ski bindings have been designed so that froces acting upward, away from the ski, are transferred first to the base plate of the binding, and from there to the ski itself. The imposition of such forces, which can be of considerable magnitude, has necessitated the design of base plates with sufficient thickness to successfully resist these forces without failing. While this poses no problem from a design standpoint, large base plates undesirably increase the weight of the ski bindings, the increased weight resulting in grater skiing fatigue and reduced performance.

BRIEF SUMMARY OF THE INVENTION

It is a first aspect of this invention, therefore, to produce a ski binding able to reliably transmit froces inposed on the carriage of the binding during skiing directly to the ski itself, over the distance through which the carriage is adjustable.

A second aspect of this invention is to reduce the weight of ski bindings by carriage attachment methods that allow the thickness of the base plate to be significantly reduced.

An additional aspect of this invention is to provide a ski binding in which the base in not utilized to the extent that it has formerly been to transmit skiing forces to the base plate.

A further aspect of this invention is to provide ski bindings in which forces are transmitted to the ski through mounting means, as opposed to the base plate.

Another aspect of this invention is to provide ski bindings that are able to employ thin, simply-shaped base plates.

Yet another aspect of the invention is to provide ski bindings in which virturally all of the forces acting on the bindings are applied in the longitudinal direction, rather than upwardly, away from the ski.

Still another aspect of the invention is to provide a better guided carriage, with respect to its movement relative to its associated base plate, as a consequence of a carriage crossbar positioned between the upper surface of the ski, and the lower surface of the base plate.

Another aspect of hte invention is to provide a ski binding utilizing a carriage fabricated by sheet metal stamping, that includes as an itegral part thereof a cross bar guide member, to which stamping may be attached various carriage elements such as soleholders, ski brakes, and the like.

Yet another aspect of the invention is to provide ski bindings in which the carriage has leg-like structures, or "leg members", that slidingly engage a slide clamp attached to the upper surface of the ski, allowing the transmission of forces acting on such members directly to the ski through the clamp.

An additional aspect of the invention is to provided the slide clamp forming part of the invention with surfaces shaped to assure minimal contact with the carriage leg members sliding therethrough, resulting in less friction and resistance to hte sliding action of the members through the clamp.

The preceding and still further aspects of the invention are provided by assembly part for a ski binding comprising:

base plate means to be attached to a ski, said base plate means having a fixed end portion to be fixed to the ski and a free end portion;

carriage means to be slidably attached to the ski relative to said base plate means, said carriage means and said base plate means being configured for the plate means to hold said carriage means near the fixed end portion against transverse movement away from the ski; and slide means tro be longitudinally spaced on the ski from the fixed end portion of said base plate means, said slide means being fixedly mounted to the ski and having holding means or holding said carriage means against transverse movement away from the ski.

The preceding an further aspects of the invention are provided by an assembly part for ski binding comprising:

an elongated base plate;

a U-shaped slide clamp; and an elongated carriage member, wherein part of said base plate, and said slide clamp are adapted to be attached to the top surface of skis by means of fastening members, and when so attached, said part of said base plate and said slide clamp are spaced apart from each other along the longitudinal axis of said skis, said slide clamp having opposing sides rising vertically from each end thereof, each of said sides having a horizontal portion extending toward the other from the side's top, and wherein said carriage member is slidably attached to said base plate by a first part of said carriage positioned beneath said extending portions, and by a second of said carriage member positioned beneath lateral edges of said base plate adjacent said part said base plate.

The preceding and additional aspects of the invention are provided by an assembly part for a ski binding comrising:

an elongated base plate;

a U-shaped slide clamp; and an elongated carriage member, wherein part of said base plate, and said slide clamp are adapted to be attached to the top surface of skis by means of fastening members, and when so attached, said part of said base plate and said slide clamp are spaced apart from each other along the longitudinal axis of said skis, said slide clamp having a horizontal crosspiece, with opposing sides rising vertically from each end thereof, each of said sides having a horizontal portion extending toward the other from the side's top, and wherein when said part of said base plate is so attached, its opposite end is supported on said horizontal crosspiece, and said base plate is maintained spaced apart from, and substantially parallel to said skis, and wherein further, said carriage member is slidably attached to said base plate by a part of said carriage positioned between said extending portions and said base plate supported on said crosspiece of said slide clamp, and by a part of said carriage member positioned beaneath lateral edges of said plate adjacent said part of said base plate.

The preceding and still additioned aspects of the invention are provided by an assembly part for a ski binding according to the preceding paragraph attached to a ski.

BRIEF DESCRIPTION OF THE DRAWINGS

The invention will be better understood when reference in had to the following drawings, in which like numbers refer to like parts, and in which:

FIG. 3 is a transverse sectional view along line III—III of FIG. 1,

FIG. 4 is a transverse sectional view along line IV—IV of FIG. 1.

FIG. 5 is a longitudinal sectional view of the slide clamp part of the invention.

Figure 1:
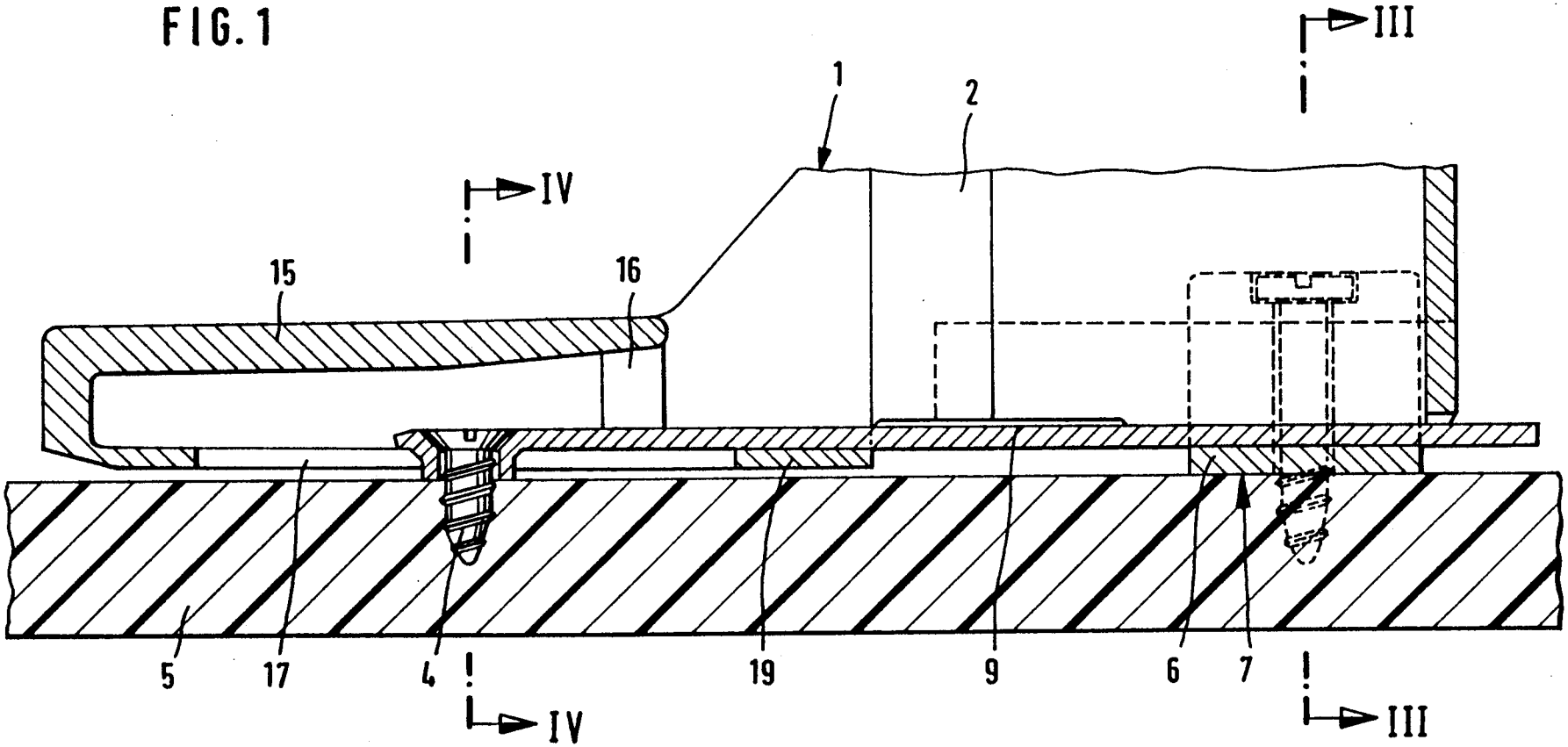
FIG. 1 is vertical sectional view along line I—I of FIG. 2, showing hte mounting portion of the ski binding part of the invention.

FIG. is a ski binding according to FIG. 1 showing a ski brake mounted thereon in phantom.

Figure 2:
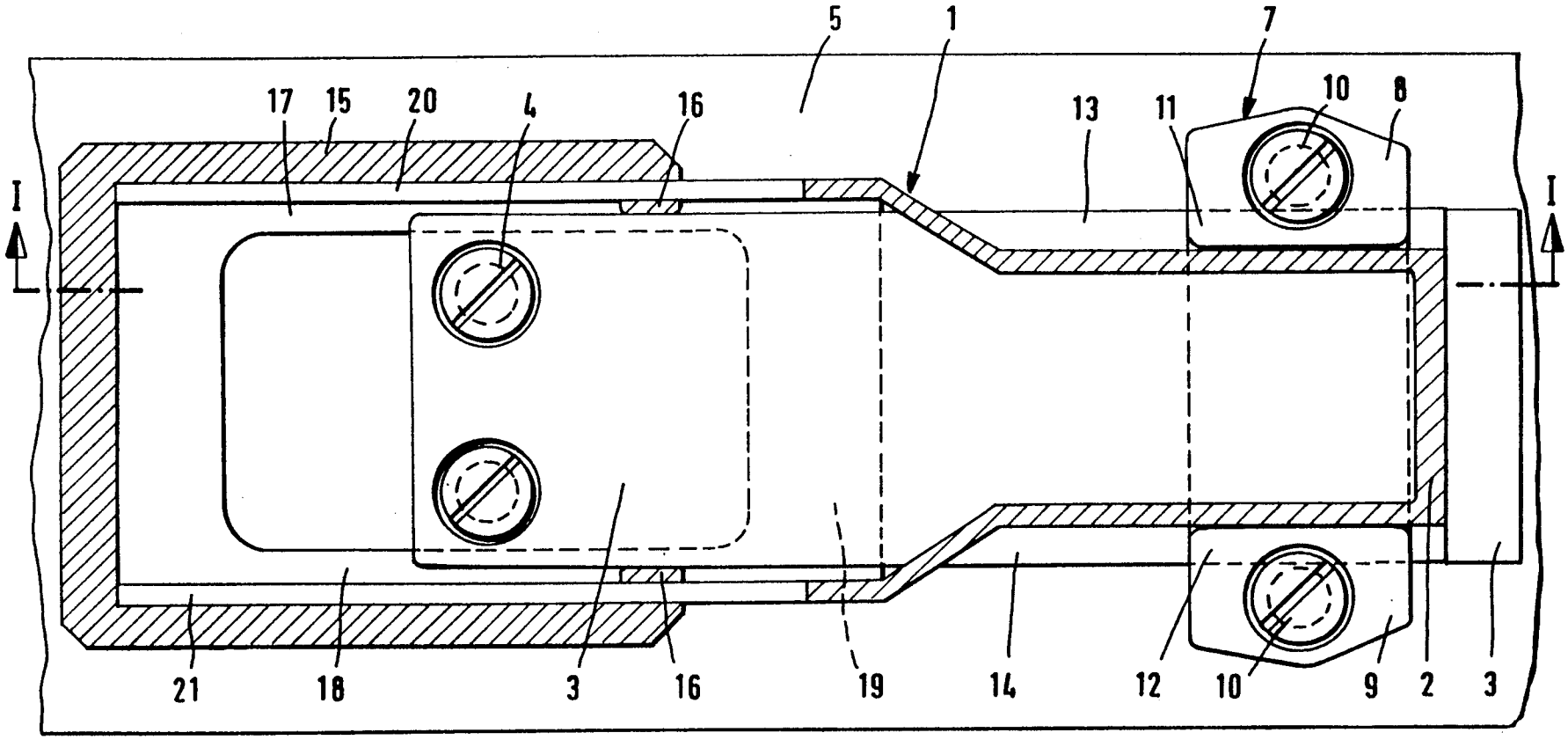
FIG. 2 is a top plan view illustrating the ski binding part of FIG. 1, sectioned through the pedal plate.
Figure 7:
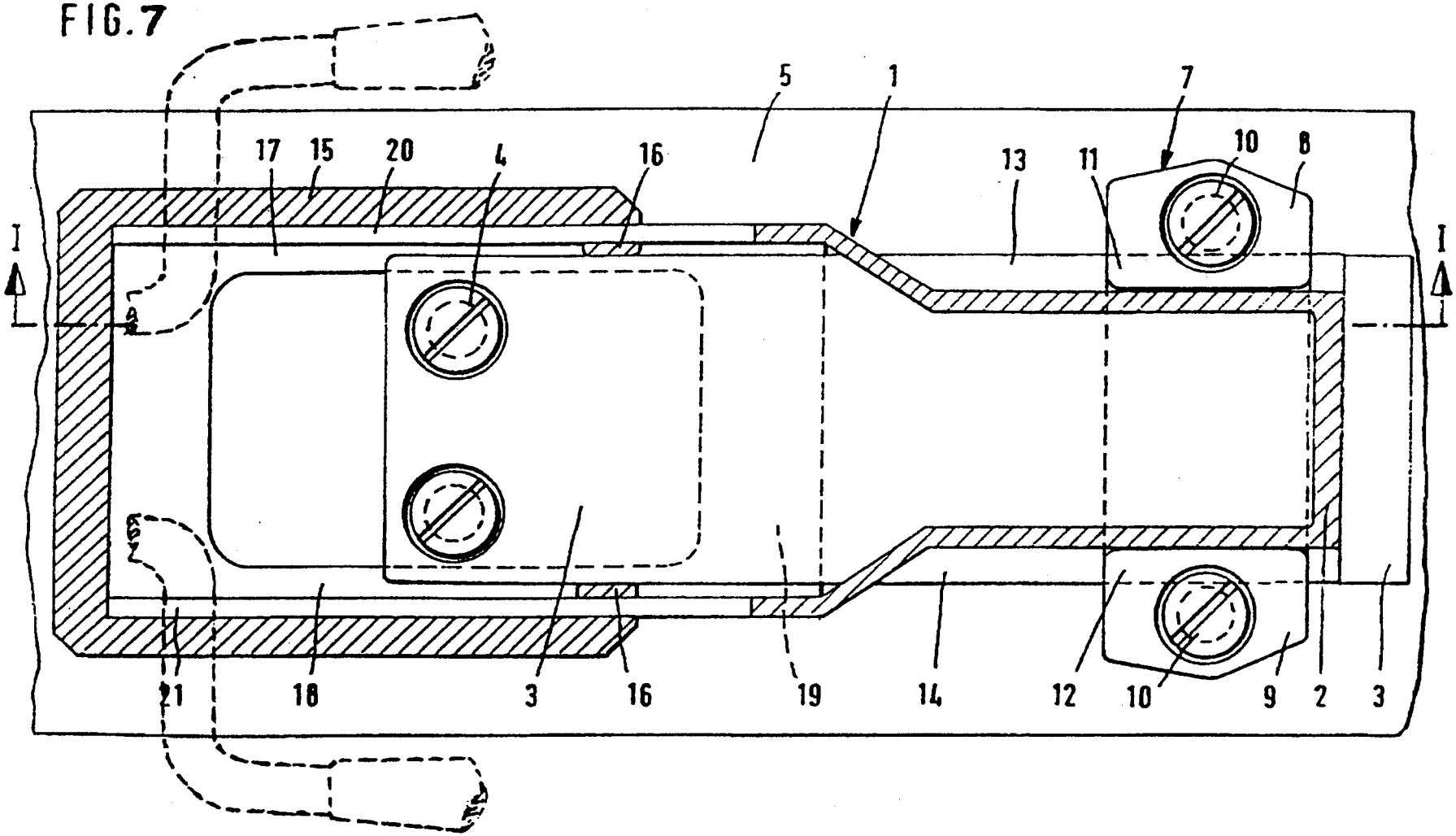

FIG. 7 is a ski binding according to FIG. 2 showing a partial phantom view of a ski brake mounted thereon.

DETAILED DESCRIPTION OF THE INVENTION

FIG. 1 is a vertical longitudinal sectional view along line I—I of FIG. 2. Shown is the part of the ski binding with which the invention is concerned, generally 1, comprising a carriage member 2 adapted to carry a soleholder, not shown, The carriage is mounted on base plate 3, and is slidingly movable relative to the base plate in the longitudinal direction of the ski.

The base plate 3, for example, a sheet metal stamping, has both a free end and an attached end, and is secured at the attached end to the ski 5 by screws 4 to form a fixed mounting. The free end of the base plate, opposite the attached end of the base plate fixedly mounted by the screws, rests upon slide clamp crosspiece 6 of a slide clamp, generally 7. The carriage 2 further includes a pedal plate 15, having a pedal plate rib 16 fastened to the ski binding assembly, as is better seen is FIG. 4. Angled edges 17, and 18 of the retainer portion of the carriage slidingly engage lateral edges of the base plate 3 adjacent the attached or fixed mounted end, simultaneously serving to lock the carriage to the base plate, and allowing it to slide back and forth longitudinally, as required.

The ski binding part with which the invention is especially concerned is a heel-holding device that essentially comprises the carriage 2, mounted on the base plate 3 so as to be displaceable relative to the ski on which the part is mounted along the ski's longitudinal axis. Such movement is required, for example, due to the fact that when a ski boot has not been inserted into the ski binding, the carriage 2 is urged by a spring, not shown, into a position of maximum extension in the binding. When a ski boot is to be inserted into the binding, pressure is applied to the carriage against the urging of the spring, allowing enough displacement of the carriage so that a ski boot can be inserted in the binding. When released, the spring presses the binding against the boot, helping to maintain the boot in its position of use on the ski.

As stated, the base plate 3 may be fabricated from a sheet metal stamping, and as in evident from the Figure, one part or end of the base plate is fixedly mounted by screws 4 in a position spaced apart from the ski to which the base plate is mounted, for examplw, as a result of bosses extending from the lower surface of the plate. The other end of the base plate rests upon, but is not connected to the crosspiece 6 of the slide clamp 7, being slidable therethrough. the crosspiece likewise serves to space the base plate apart from the ski 5, allowing the plate to be positioned parallel to. and spaced apart from the ski so as to admit angled adges 17 and 18 into the space thus formed. Screws are provided that fasten the slide clamp to the ski.

FIG. 2 is a top plan view showing the ski binding shown in FIG. 1 with the pedal plate sectioned to reveal inner details of the assembly. In ski binding 1 may be seen ski carriage 2 mounted on the base plate 3. the screws 4 hold one end of the base plate fixedly to the ski 5, while the other end lies loosely on the crosspiece of slide clamp 7. Screws 10 extending through the vertical sides 8 and 9 of the slide clamp 7 fasten the clamp to the ski. The horizontal protions 11 and 12 extending from the top of the clamp's vertical sides, hold the ski carriage 2 to the ski by means of carriage projections 13 nd 14 which are interposed between the horizontal portions of the slide clamp sides and the base plate resting on the slide clamp crosspiece, as is better seen in FIG. 3. Pedal plate 15 has attached thereto a pedal plate rib 16, which facilitates guidance of the carriage in its longitudinal movement back and forth along the base plate, as is more clearly seen in FIG. 4. The carriage 2 is also provided with horizontal angled edges 17 and 18 which are interposed between the lateral edges of the base plate 3, and the upper surface of the ski 5. These, together with the slide clamp 7 fasten the carriage to the base plate in a sliding relationship. Guiding of the carriage along the base plate is also facilitated by the carriage crossbar 19 which moves back and forth in the space between the base plate and the upper surface of the ski. Pedal plate support member 20 provides a method of incorporating the pedal plate in the carriage, as shown in FIG. 4.

In wll be seen from FIG. 2 that the sides of the carriage may be advantageously offset toward the center as they pass through the slide clamp, thereby permitting the width of the clamp to be minimized.

FIG. 3 is a transverse sectional view taken along line III—III of FIG. 1. The Figure shows how the slide clamp 7 is fastened to the ski 5 by means of screws 10 extending through the slide clamp sides 8 and 9. Also shown is the way in which the carriage 2 is slidably engaged in the clamp 7 by projections 13 and 14 between the horizontal portions of the slide clamp sides, 11 and 12, and the base plate 3 resting on the slide clamp crosspiece 6, holding the carriage to the ski and allowing upward forces experienced during skiing to be transferred directly to the ski itself, rather than to the base plate.

The carriage 2 is provided with a sufficient length extending away from the slide clamp 7 beyond the fixedly mounted end of the base plate 3, so that the horizontally angled edges extending beneath the base plate at its fixed end also hold hte carriage to the ski as previously described.

FIG. 4 illustrates a transverse sectional view along line IV—IV of FIG. 1. The Figure shows the base plate 3 attached to the ski 5 by screws 4, and spaced apart therefrom by bosses extending downward from the lower surface of the base plate. The sliding relationship resulting from the positioning of the angled edge retainer portions 17 and 18 of the carriage under the lateral edges of the base plate can be seen more clearly, as can be the carriage crossbar 19, the latter being slidably positioned in the space between the base plate 3 nd ski 5. Also shown is pedal plate 15, as well as the "plut fit" that fastens the pedal plate to pedal support members 20 and 21. The U-shaped transverse cross-section portion of the carriage 2 is readily visualized from the Figure, while the two parallel, elongated leg members repesenting still another portion of the carriage, and of which the projections 13 and 14 form a part, are better seen in FIG. 3.

As is apparent from an examination of FIGS. 3 and 4, only at the fixed mounting end of the base plate shown in FIG. 4, does the base plate transmit upward forces from the carriage to the ski; however, since the base plate is firmly secured to the ski at that point, the plate is sufficiently strong to withstand the load there, despite the plate's lightweight construction.

While the carriage 2 may be desirably fabricated from a sheet metal stamping, the pedal plate may be readily made from plastic if desired.

FIG. 5 is a longitudinal sectional view showing a further embodiment of a slide clamp. As shown, the clamp 7' includes a slide clamp crosspiece 6' designed to mininmize the area of contact between the portion of the carriage extending therethrough, i.e., the parellel elongated leg members of which the projections 13 and 14 form a part. The horizontal portion of the slide clamp 11' is similarly fashioned, as may be the inner surface of the slide clamp side 8'. As shown, the reduced area is achieved by forming the areas so that they comprise two planar surfaces meeting in a line at right angles to the longitudinal axis of the clamp, forming an obtuse angle. Other surfaces, however, might also be formed to provide minimal contact areas, however, for example, a convex surface. By fabricating the clamp so as to provide a minimal contact area, not only is friction between the clamp surfaces and the leg members decreased, but jamming of the parts is avoided when the ski is deflected.

Figure 6:
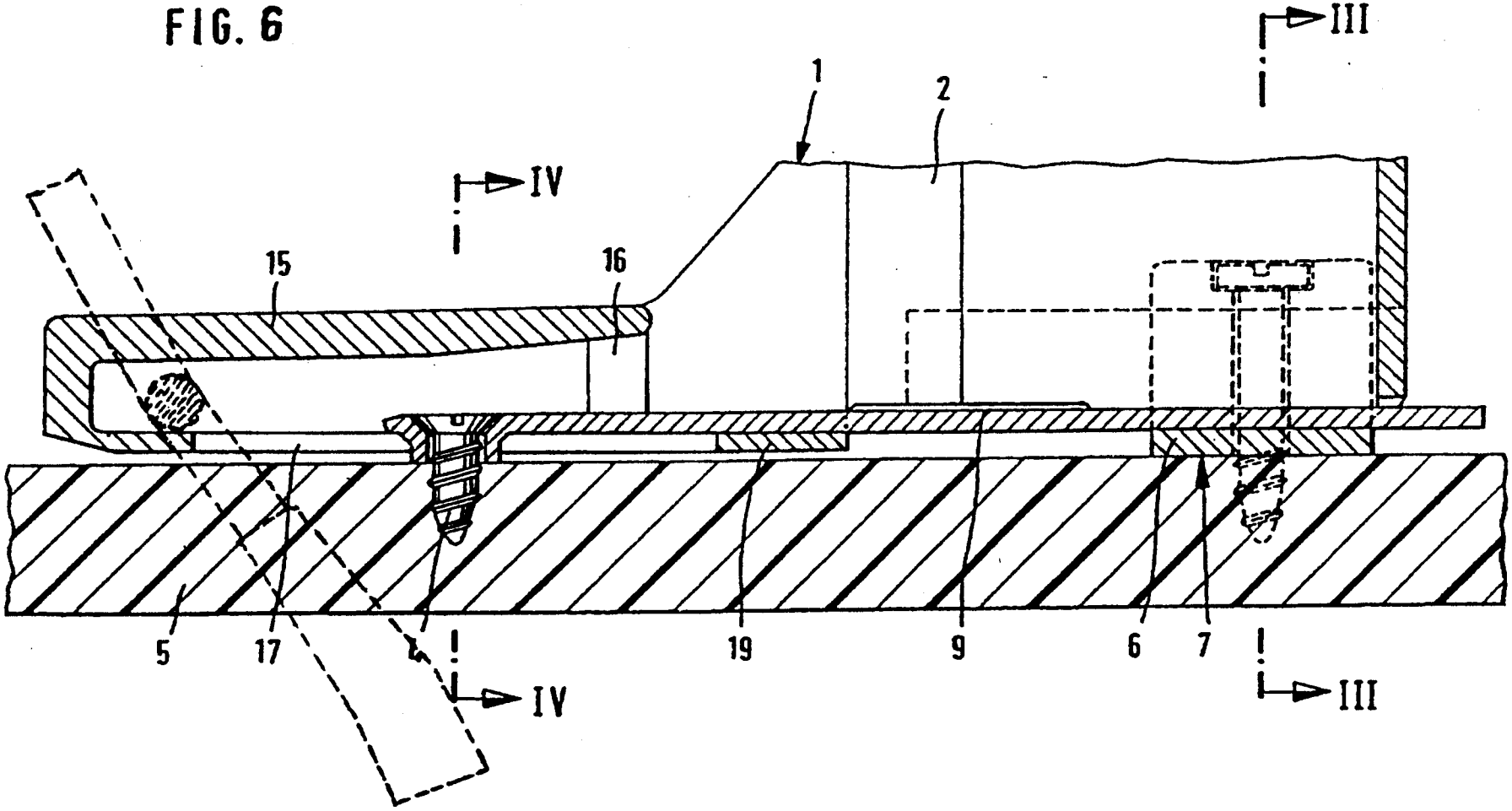

As indicated earlier, ski brakes can be incorporated on the ski carriage rather than being attached to the base plate or other member fixed to the ski. One such ski brake, which can be one of a pair of ski brakes, is shown in FIGS. 6–7. FIGS. 6–7 have the same parts as FIGS. 1–2 and will not be repeated here. The ski brake can be of many sorts, and is shown in dotted lines as item 30. Brake 30 has a part which is depressed when a skier's boot is in the binding to move brake 30 to its upraised, skiiing position. The free end of the brake which is in its position beneath the ski when the brake is in its braking condition, i.e. when the boot is not in the ski is shown. Ski brake 30 also has a configured part which is acted on by some part of the binding to move the brake between its skiing and braking conditions. The means for operating the brake is not shown. Likewise, the exact configuration of the brake is also not shown.

Although the embodiment of the invention described in the preceding emphasizes the usefulness of the invention with a heel-holding part of a ski binding, the invention may also be embodied in a toe holding unit, provided that the latter unit is longitudinally slidably mounted on its base plate.

While in accordance with the patent statues, a preferred embodiment and best mode has been presented, the scope of the invention is not limited thereto, but rather is measured by the scope of the attached claims.

What is claimed is:

1. A ski binding comprising:

base plate measn to be attached to a ski, said base plate means having a fixed end portion and a free end portion said fixed end portion adapted to be fixedly attached to the ski with said plate being spaced from the ski;

carriage means adapted to be slidably attached to the ski relative to said base plate means, said carriage means having a transverse portion extending below said base plate means adjacent said fixed end portion for holding said carriage means against transverse movement away from the ski; and slide means clamp longitudinally spaced on the ski from the fixed end portion of said base plate means, and separate from said base plate means, said slide clamps means being fixedly mountable to the ski and having holding means including means extending below the free end of said base plate means and means extending above portions of said carriage means for holding said carriage means and said free end portion of said base plate means against transverse movement away from the ski.

2. The ski binding according to claim 1, further including lifting means for lifting part of said base plate means away from the ski near said fixed end portion, and a portion of said carriage being inserted between the ski and the lifted part to hold said carriage means against transverse movement away from the ski.

3. The ski binding according to claim 1 wherein said slide clamp means comprises opposing side members and a crosspiece means extendable across the ski to connect said side members, said base plate means resting on said crosspiece means; and projections on said carriage means cooperating with said crosspiece means to prevent said carriage which rests means on said base plate means from being movable transversely relative to the ski.

4. An assembly part for a ski binding comprising:

an elongated base plate;

a U-shaped slide clamp; and an elongated carriage member, wherein a first end of said base plate, and said slide clamp are adapted to be attached to the top surface of skis by means of fastening members, and when so attached, said first end of said base plate and said slide clamp are spaced apart from each other along the longitudinal axis of said skis, a second end of said base plate being unattached to said top surface and to said slide clamp and resting upon a horizontal cross-piece of said slide clamp;

said slide clamp having opposing sides rising vertically from each end of said horizontal cross-piece, each of said sides having a horizontal portion extending toward the other from the side's top, and wherein said carriage member is slidably attached to said base plate by a first end part of said carriage positioned beneath said extending portions of said slide clamp, and by a second end part of said carriage member positioned beneath said base plate and its extending lateral edges adjacent said first end of said base plate.

5. An assembly part according to claim 4 characterized in that said base plate is spaced apart from said ski adjacent said part by means of bosses extending from the lower surface of said base plate at said one end.

6. An assembly part according to claim 5 characterized in that said fastening members are threaded fasteners.

7. An assembly part according to claim 5 characterized in that said carriage includes a crossbar as a part thereof, located beneath said base member at right angles to the longitudinal axis of said assembly.

8. An assembly part according to claim 7 characterized in that said carriage comprises a sheet metal stamping of which said crossbar is an integral part.

9. An assembly part according to claim 8 characterized in that a portion of said sheet metal stamping has an elongated U-shaped transverse cross-section that includes as a part thereof a web constituting said crossbar, and said portion has two parallel, elongated leg members extending therefrom along the longitudinal axis of said assembly to which other elements of said carriage may be connected.

10. An assembly part according to claim 9 characterized in that said leg members are slidably engaged by said slide clamp.

11. An assembly part according to claim 10 characterized in that the distance between said leg members is less than the distance between the vertical sides of said U-shaped portion.

12. An assembly part according to claim 4 characterized in that at least some of the interior surfaces of the slide clamp are shaped to minimize the area of contact with surfaces of the carriage member in contact therewith.

13. An assembly part according to claim 12 characterized in that each of said interior shaped surfaces comprises two planar surfaces that join each other in a line perpendicular to the clamp's longitudinal axis so as to form an obtuse angle therebetween.

14. An assembly part according to claim 4 which is a heel-piece assembly part.

15. An assembly part according to claim 4 in combination with a ski.

16. An assembly part for a ski binding comprising:

an elongated base plate;

a U-shaped slide clamp; and an elongated carriage member, wherein a first end of said base plate, and said slide clamp are adapted to be attached to the top surface of skis by means of fastening members, and when so attached, said first end of said base plate and said slide clamp are spaced apart from each other along the longitudinal axis of said skis, and a second end of said base plate is unattached to said top surface, and to said slide clamp.

said slide clamp having a horizontal cross-piece with opposing sides rising vertically from each end thereof, each of said sides having a horizontal portion extending toward the other from the side's top, and wherein when said first end of said base plate is so attached, its second end is supported on said horizontal cross-piece, and said base plate is maintained spaced apart from, and substantially parallel to said skis, and wherein further said carriage member is slidably attached to said base plate by a first end part of said carriage positioned between said extending portions of said slide clamp and said base plate supported on said cross-piece of said slide clamp, and by a second end part of said carriage positioned beneath said base plate and its extending lateral edges adjacent said first end of said base plate.

* * * * *

UNITED STATES PATENT AND TRADEMARK OFFICE

CERTIFICATE OF CORRECTION

PATENT NO. : 5,143,397

DATED : September 1, 1992

INVENTOR(S) : Premek Stepanek and Ludwig Wagner

It is certified that error appears in the above-identified patent and that said Letters Patent is hereby corrected as shown below:

On the title page, item [22], the filing date should read: Aug. 3, 1989.

Signed and Sealed this

Twenty-first Day of September, 1993

Bruce Lehman

*Attest:*

BRUCE LEHMAN

*Attesting Officer*

*Commissioner of Patents and Trademarks*